US011441435B2

(12) United States Patent
Moore et al.

(10) Patent No.: US 11,441,435 B2
(45) Date of Patent: Sep. 13, 2022

(54) VANE ARRANGEMENT FOR A TURBO-MACHINE

(71) Applicant: Cummins Ltd, Huddersfield (GB)

(72) Inventors: Simon David Moore, Huddersfield (GB); Matthew William Edwards, Huddersfield (GB); Stephen David Hughes, Huddersfield (GB); George E. Sanford, Huddersfield (GB); Nandakishore Arcot Madhusudan, Huddersfield (GB)

(73) Assignee: CUMMINS LTD, Huddersfield (GB)

( * ) Notice: Subject to any disclaimer, the term of this patent is extended or adjusted under 35 U.S.C. 154(b) by 0 days.

(21) Appl. No.: 16/349,338

(22) PCT Filed: Nov. 13, 2017

(86) PCT No.: PCT/GB2017/053413
§ 371 (c)(1),
(2) Date: May 13, 2019

(87) PCT Pub. No.: WO2018/091871
PCT Pub. Date: May 24, 2018

(65) Prior Publication Data

US 2019/0292924 A1 Sep. 26, 2019

(30) Foreign Application Priority Data

Nov. 15, 2016 (GB) ..... 1619347

(51) Int. Cl.
*F01D 17/16* (2006.01)
*F01D 9/04* (2006.01)
*F01D 5/14* (2006.01)

(52) U.S. Cl.
CPC ..... *F01D 9/041* (2013.01); *F01D 5/141* (2013.01); *F01D 9/04* (2013.01); *F01D 17/16* (2013.01);
(Continued)

(58) Field of Classification Search
CPC . F01D 9/041; F01D 9/04; F01D 9/044; F01D 1/02; F01D 11/14
(Continued)

(56) References Cited

U.S. PATENT DOCUMENTS 4,844,690 A * 7/1989 DeLaurier ..... F01D 17/143 415/148
5,452,986 A * 9/1995 Osborne ..... F04D 29/462 415/150
(Continued)

FOREIGN PATENT DOCUMENTS

CN 101542074 A 9/2009
CN 101624922 A 1/2010
(Continued)

OTHER PUBLICATIONS

International Search Report and Written Opinion issued by the European Patent Office, dated Jan. 25, 2018, for International Application No. PCT/GB2017/053413; 9 pages.
(Continued)

*Primary Examiner* — Michael L Sehn
(74) *Attorney, Agent, or Firm* — Faegre, Drinker, Biddle & Reath, LLP

(57) ABSTRACT

A turbine for a turbo-machine is proposed in which, at a gas inlet, vanes, extending from a nozzle ring though slots in a shroud, are shaped on one side to as to substantially conform to the profile of the surface of the slot, whereby a close connection can be formed between the vane and the slot to inhibit leakage of gas between the vane and the slot surface.

20 Claims, 7 Drawing Sheets

(52) U.S. Cl.
CPC .... *F05D 2220/40* (2013.01); *F05D 2250/711* (2013.01)

(58) Field of Classification Search
USPC ..... 415/151
See application file for complete search history.

(56) References Cited

U.S. PATENT DOCUMENTS

| | | | | |
|---|---|---|---|---|
| 7,097,432 | B1 | 8/2006 | Lombard et al. | |
| 8,221,059 | B2 * | 7/2012 | Brown | F01D 17/167 415/158 |
| 8,636,467 | B2 * | 1/2014 | Carter | F01D 17/167 415/158 |
| 8,821,112 | B2 * | 9/2014 | Garrett | F01D 9/026 415/157 |
| 8,979,485 | B2 * | 3/2015 | Baker | F01D 17/14 415/158 |
| 9,488,065 | B2 * | 11/2016 | Olmstead | F01D 17/143 |
| 9,664,193 | B2 | 5/2017 | Fledersbacher et al. | |
| 2015/0345376 | A1 | 12/2015 | Ibaraki et al. | |
| 2015/0361875 | A1 * | 12/2015 | Parker | F01D 17/165 415/146 |

FOREIGN PATENT DOCUMENTS

| | | | |
|---|---|---|---|
| DE | 4315474 | C1 | 9/1994 |
| DE | 102010053077 | A1 | 8/2011 |
| DE | 102011109643 | A1 | 2/2013 |
| DE | 102011120555 | A1 | 6/2013 |
| DE | 102012003214 | A1 | 8/2013 |
| DE | 102013002192 | A1 | 8/2014 |
| GB | 2458191 | A | 9/2009 |
| GB | 2462115 | A | 1/2010 |
| GB | 2497786 | A | 6/2013 |
| WO | 2009118528 | A1 | 10/2009 |
| WO | 2010058788 | A1 | 5/2010 |

OTHER PUBLICATIONS

Search report issued by the UKIPO, dated Apr. 5, 2017, for International Application No. GB1619347.6; 4 pages.

* cited by examiner

VANE ARRANGEMENT FOR A TURBO-MACHINE

CROSS-REFERENCE TO RELATED APPLICATIONS

This application is a national phase filing of International Application No. PCT/GB2017/053413, titled VANE ARRANGEMENT FOR A TURBO-MACHINE, filed Nov. 13, 2017, which claims reference to United Kingdom Application No. 1619347.6, filed Nov. 15, 2016, the disclosures of which being expressly incorporated herein by reference.

FIELD OF THE INVENTION

The present invention relates to variable vane arrangement for positioning at a gas inlet of a turbo-machine such as a turbo-charger.

BACKGROUND OF THE INVENTION

Turbochargers are well-known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the inlet manifold of the engine, thereby increasing engine power. The turbocharger shaft is conventionally supported by journal and thrust bearings, including appropriate lubricating systems, located within a central bearing housing connected between the turbine and compressor wheel housing.

In known turbochargers, the turbine stage comprises a turbine chamber within which the turbine wheel is mounted; an annular inlet passageway defined between facing radial walls arranged around the turbine chamber; an inlet arranged around the inlet passageway; and an outlet passageway extending axially from the turbine chamber. The passageways and chambers communicate such that pressurised exhaust gas admitted to the inlet chamber flows through the inlet passageway to the outlet passageway via the turbine and rotates the turbine wheel.

It is known to improve turbine performance by providing vanes, referred to as nozzle vanes, in the inlet passageway so as to deflect gas flowing through the inlet passageway towards the direction of rotation of the turbine wheel. Each vane is generally laminar, and is positioned with one radially outer surface arranged to oppose the motion of the exhaust gas within the inlet passageway, i.e. the circumferential component of the motion of the exhaust gas in the inlet passageway is such as to direct the exhaust gas against the outer surface of the vane.

Turbines may be of a fixed or variable geometry type. Variable geometry type turbines differ from fixed geometry turbines in that the geometry of the inlet passageway can be varied to optimise gas flow velocities over a range of mass flow rates so that the power output of the turbine can be varied to suit varying engine demands.

In one form of a variable geometry turbocharger, a nozzle ring carries a plurality of axially extending vanes, which extend into the air inlet, and through respective apertures ("slots") in a shroud which forms a radially-extending wall of the air inlet. The nozzle ring is axially movable by an actuator to control the width of the air passage. Movement of the nozzle ring also controls the degree to which the vanes project through the respective slots.

An example of such a variable geometry turbocharger is shown in FIGS. 1(*a*) and 1(*b*), taken from U.S. Pat. No. 8,172,516. The illustrated variable geometry turbine comprises a turbine housing 1 defining an inlet chamber 2 to which gas from an internal combustion engine (not shown) is delivered. The exhaust gas flows from the inlet chamber 2 to an outlet passageway 3 via an annular inlet passageway 4. The inlet passageway 4 is defined on one side by the face of a movable annular wall member 5 which constitutes the nozzle ring, and on the opposite side by an annular shroud 6, which covers the opening of an annular recess 8 in the facing wall.

Gas flowing from the inlet chamber 2 to the outlet passageway 3 passes over a turbine wheel 9 and as a result torque is applied to a turbocharger shaft 10 supported by a bearing assembly 14 that drives a compressor wheel 11. Rotation of the compressor wheel 11 about rotational axis 100 pressurizes ambient air present in an air inlet 12 and delivers the pressurized air to an air outlet 13 from which it is fed to an internal combustion engine (not shown). The speed of the turbine wheel 9 is dependent upon the velocity of the gas passing through the annular inlet passageway 4. For a fixed rate of mass of gas flowing into the inlet passageway, the gas velocity is a function of the width of the inlet passageway 4, the width being adjustable by controlling the axial position of the nozzle ring 5. As the width of the inlet passageway 4 is reduced, the velocity of the gas passing through it increases. FIG. 1(*a*) shows the annular inlet passageway 4 closed down to a minimum width, whereas in FIG. 1(*b*) the inlet passageway 4 is shown fully open.

The nozzle ring 5 supports an array of circumferentially and equally spaced vanes 7, each of which extends across the inlet passageway 4. The vanes 7 are orientated to deflect gas flowing through the inlet passageway 4 towards the direction of rotation of the turbine wheel 9. When the nozzle ring 5 is proximate to the annular shroud 6 and to the facing wall, the vanes 7 project through suitably configured slots in the shroud 6 and into the recess 8. Each vane has an "inner" major surface which is closer to the rotational axis, and an "outer" major surface which is further away.

A pneumatically or hydraulically operated actuator 16 is operable to control the position of the nozzle ring 5 within an annular cavity 19 defined by a portion 26 of the turbine housing via an actuator output shaft (not shown), which is linked to a stirrup member (not shown). The stirrup member in turn engages axially extending guide rods (not shown) that support the nozzle ring 5. Accordingly, by appropriate control of the actuator 16 the axial position of the guide rods and thus of the nozzle ring 5 can be controlled. It will be appreciated that electrically operated actuators could be used in place of a pneumatically or hydraulically operated actuator.

The nozzle ring 5 has axially extending inner and outer annular flanges 17 and 18 respectively that extend into the annular cavity 19, which is separated by a wall 27 from a chamber 15. Inner and outer sealing rings 20 and 21, respectively, are provided to seal the nozzle ring 5 with respect to inner and outer annular surfaces of the annular cavity 19, while allowing the nozzle ring 5 to slide within the annular cavity 19. The inner sealing ring 20 is supported within an annular groove 22 formed in the inner surface of the cavity 19 and bears against the inner annular flange 17 of the nozzle ring 5, whereas the outer sealing ring 21 is supported within an annular groove 23 provided within the annular flange 18 of the nozzle ring 5 and bears against the radially outermost internal surface of the cavity 19. It will be appreciated that the inner sealing ring 20 could be mounted in an annular groove in the flange 17 rather than as shown, and/or that the outer sealing ring 21 could be mounted within an annular groove provided within the outer surface of the cavity rather than as shown. A first set of pressure balance apertures 25 is provided in the nozzle ring 5 within the vane passage defined between adjacent apertures, while a second set of pressure balance apertures 24 are provided in the nozzle ring 5 outside the radius of the nozzle vane passage.

In known variable geometry turbo-machines which employ vanes projecting through slots in a shroud, a clearance is provided between the vanes and the edges of the slots to permit thermal expansion of the vanes as the turbocharger becomes hotter. As viewed in the axial direction, the vanes and the slots have the same shape, but the vanes are smaller than the slots. In a typical arrangement, the vanes are positioned with an axial centre line of each vane in a centre of the corresponding slot, such that in all directions away from the centre line transverse to the axis of the turbine, the distance from the centre line to the surface of the vane is the same proportion of the distance from the centre line to the edge of the corresponding slot. The clearance between the vanes and the slots is generally arranged to be at least about 0.5% of the distance of a centre of the vanes from the rotational axis (the "nozzle radius") at room temperature (which is here defined as 20 degrees Celsius) around the entire periphery of the vane (for example, for a nozzle radius of 46.5 mm the clearance may be 0.23 mm, or 0.5% of the nozzle radius). This means that, if each of the vanes gradually thermally expands perpendicular to the axial direction, all points around the periphery of the vane would touch a corresponding point on the slot at the same moment. At all lower temperatures, there is a clearance between the entire periphery of the vane and the edge of the corresponding slot.

SUMMARY OF THE INVENTION

The present invention aims to provide new and useful vane assemblies for use in a turbo-machine, as well as new and useful turbo-machines (especially turbo-chargers) incorporating the vane assemblies.

In general terms, the present invention proposes that in the turbine of a turbomachine of the kind in which, at a gas inlet vanes project through slots in a shroud to a degree controlled by an actuator, one surface of each vane substantially conforms to the shape of a corresponding surface of the the corresponding slot, so as to enable a smaller clearance between them.

In one form of the invention, a smaller clearance is provided between the vanes and the surfaces of the slots in locations on the inner surface face of each vane, than on an outer surface of each vane.

In an alternative form of the invention, a smaller clearance may be provided between the vanes and the surfaces of the slots in locations on the outer surface of the vane, than on the inner surface of each vane.

In either case, a surface of each vane is formed to have a profile very similar to that of a facing edge of the corresponding shroud slot, so that the vane can be positioned closely against the edge of the slot. The clearance on that side of the vane may be so small as to inhibit, or even substantially prevent, leakage of gas between the vane and the slot on that side of the vane.

The invention is motivated by an observation made by present inventors that, in turbine arrangements in which vanes project from a nozzle ring through slots in a shroud, gas can leak through the clearances between the shroud and the vanes, and this causes significant losses in efficiency because gas can pass from the outer surface of the vane to the inner surface of the vane. By closing the gap between the vane and the slot on one side of the vane, this leakage can be significantly reduced.

Specifically, a first aspect of the invention provides a turbine having:

- a turbine housing defining a gas inlet; and
- a turbine wheel positioned for rotation within the turbine housing about an axis;
- a ring-shaped shroud defining a plurality of slots, and encircling the axis; and
- a nozzle ring supporting a plurality of vanes which extend from the nozzle ring parallel to the axis, and project through respective ones of the slots, each of the vanes being spaced from the axis by a nozzle radius; and
- a coupling mechanism for coupling the shroud to the nozzle ring;
- each of the slots having an inwardly-facing slot surface, and each of the vanes having an axially-extending vane surface which includes (i) a vane outer surface facing an outer surface of the corresponding slot, (ii) an opposed vane inner surface facing an inner surface of the corresponding slot, and (iii) a median line between the vane inner surface and the vane outer surface extending from a first end of the vane to a second end of the vane;
- the vane surface including a conformal portion, extending along at least 80% of the length of the median line, and facing a corresponding conformal portion of the slot surface, wherein, at room temperature, the respective profiles of the conformal portion of the vane surface and the corresponding conformal portion of the slot surface diverge from each other by no more than 0.35% of the nozzle radius, and preferably no more than 0.3%, 0.2% or even 0.1% of the nozzle radius.

Preferably, the conformal portion of the vane surface includes at least 80%, and more preferably at least 90% of the length of the median line.

In this document the statement that two lines diverge from each other by no more than a certain distance x may be understood to mean that the lines can be placed such that the lines do not cross and such that no point along either one of the lines is further than a distance x from the other of the lines.

The conformal portion of the vane surface may include a portion of one of the convex end portions of the vane surface. If the conformal surface is on the inner face of the vane, this is typically the conformal portion at a leading edge of the vane. If the conformal surface is on the outer face of the vane, this is typically the trailing edge of the vane. Preferably, the conformal portion of the vane surface includes at least the portion of the convex end portion of the vane surface between the first major vane surface and the median line.

Due to the conformity of the profiles of the corresponding portions of the conformal portion of the vane surface of the vane and the corresponding portion of the surface of the slot, those portions can be arranged in close proximity. The range of positions in which the vane can be positioned relative to the corresponding slot is limited by the fact that the nozzle ring and shroud can only be moved axially and/or rotated about the axis. It may be further limited by the coupling mechanism which couples the nozzle ring to the shroud. Preferably, at room temperature, the corresponding portions of the conformal portion of the vane surface of the vane and the corresponding portion of the surface of the slot can be positioned with a gap of no more than 0.35%, no more than 0.3%, no more than 0.2% or even no more than 0.1% of the nozzle radius (e.g. for a 48.1 mm nozzle radius, a gap of no more than 0.17 mm, no more than 0.1 mm, or even no more than 0.05 mm) between them along the whole of their respective lengths. Thus, leakage of gas between the vane inner surface and the slot inner surface can be reduced.

Note that this is in contrast to the known vane and slot arrangement discussed above, in which the vane and slot have the same shape as viewed in the axial direction, but have different sizes at room temperature, so that each portion of the vane surface of has a different radius of curvature from the nearest portion of the slot surface.

More preferably, the conformal portion of the vane surface extends along at least 80%, or at least 85%, of the length of the median line, and preferably along at least 90% of the length of the median line. Preferably, the profile of the conformal portion of the vane surface diverges from the profile of the corresponding portion of the slot surface by no more than 0.2% of the nozzle radius (e.g. 0.1 mm for a 48.1 mm nozzle radius) throughout their respective lengths.

In some embodiments, the conformal portion of the vane is positionable in contact with the corresponding portion of the edge of the slot along substantially the whole of the length of the conformal portion. For example, there may be more than two points of contact between them, and the maximum distance of any point of the conformal portion of the vane surface from the slot surface is no greater than 0.35%, 0.3% or even 0.2% of the nozzle radius. For example, in the case of a nozzle radius of 48.1 mm, the maximum distance of any point of the conformal portion of the vane surface from the slot surface may be no greater than 0.17 mm, 0.15 mm or even 0.10 mm.

At temperatures higher than room temperature, the vanes and shroud will experience thermal expansion. Since the clearance between the conformal portion of the vane surface and the corresponding portion of the slot surface is small, at high temperatures expansion may bring the vane and the slot into contact, or even press them together, which would impede axial movement of the nozzle ring. However, flexibility in the support structure which supports the vanes in relation to the shroud surface may be enough to permit the vane to retract away from the inner surface of the shroud, to prevent the respective surfaces being pressed together with high force.

Thus, the invention makes possible a turbine in which the vane and slots are, or can be, positioned such that on average over the conformal portion of the vane surface, the gap between the vane inner surface and the slot inner surface at room temperature is no more than 20%, and preferably no more than 10% or even 5%, of the gap between the vane outer surface and the slot outer surface; or, conversely, the gap between the vane outer surface and the slot outer surface is no more than 20%, and preferably no more than 10% or even 5%, of the gap between the vane inner surface and the slot inner surface.

BRIEF DESCRIPTION OF THE FIGURES

Embodiments of the invention will now be described for the sake of example only, with reference to the following drawings in which.

DETAILED DESCRIPTION OF THE EMBODIMENTS

Figure 1A:
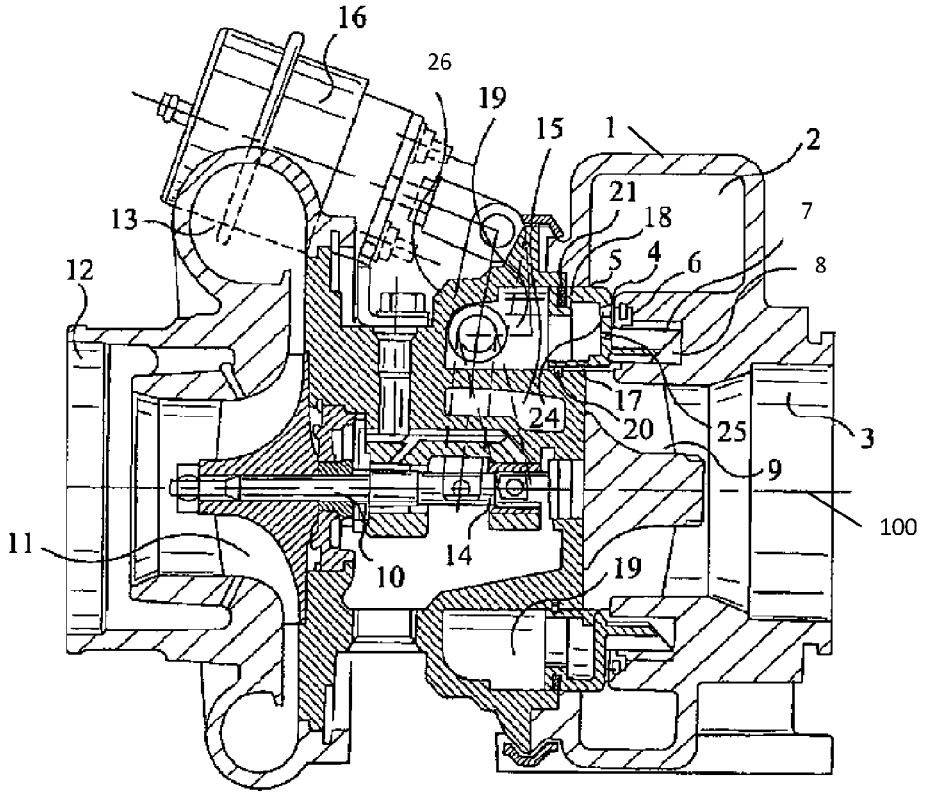
FIG. 1 is composed of FIG. 1(*a*) which is an axial cross-section of a known variable geometry turbine, and FIG. 1(*b*) which is a cross-section of a part of the turbine of FIG. 1(*a*)
Figure 1B:
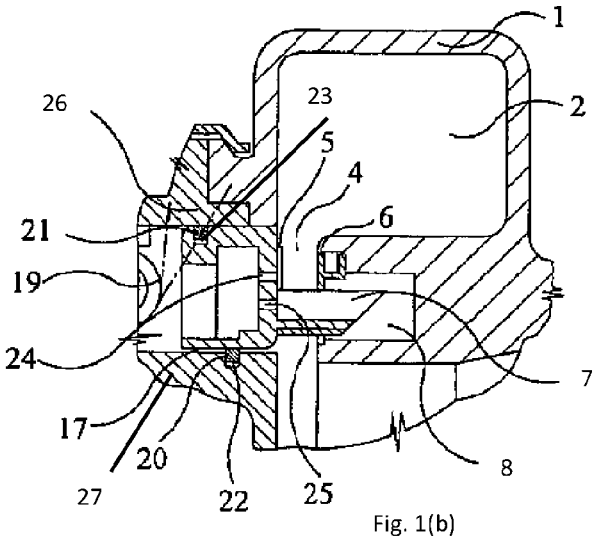
Figure 2:
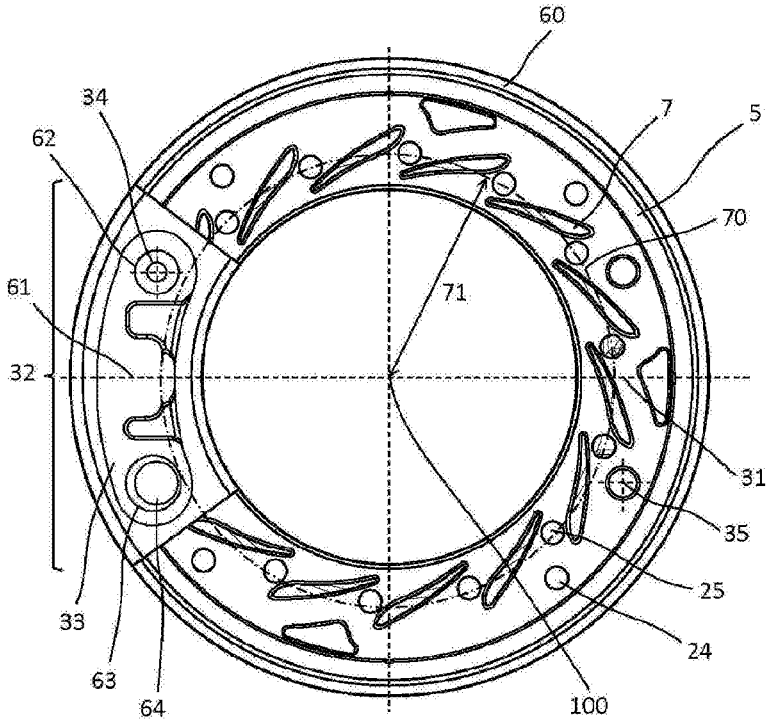
FIG. 2 is an axial view of a vane arrangement which can used in the known arrangement of FIG. 1.

Referring to FIG. 2, a vane arrangement is shown which could be used in the known system of FIG. 1. The vane arrangement is viewed in the axial direction, from the right as viewed in FIG. 1(*a*), from a position between the nozzle ring 5 and the shroud 6.

The axis of the shaft about which the turbine wheel 9 (not shown in FIG. 2, but visible in FIG. 1(*a*)) and compressor wheel 11 (also not shown in FIG. 2, but visible in FIG. 1(*a*)) rotate is denoted as 100.

Viewed in this axial direction, the substantially-planar annular nozzle ring 5 encircles the axis 100. From the nozzle ring 5, vanes 7 project in the axial direction. Defining a circle 70 centred on the axis 100 and passing through the centroids of the profiles of the vanes 7, we can define the nozzle radius 71 as the radius of the circle 70.

The nozzle ring 5 is moved axially by an actuator (not shown in FIG. 2, but visible in FIG. 1(*a*)) within an annular cavity (also not shown in FIG. 2, but visible in FIG. 1(*a*)) defined by a portion 60 of the turbine housing. Each vane 7 is optionally longitudinally-symmetric (that is, its profile as viewed in the axial direction, may be same in all axial positions), although in some embodiments only a portion of the vane 7 is longitudinally-symmetric.

The actuator exerts a force on the nozzle ring 5 via two axially-extending guide rods. In FIG. 2, a portion 32 of the nozzle ring 5 is omitted, making it possible to view the connection between the nozzle ring 5 and a first of the guide rods. The guide rod is not shown, but its centre is in a position labelled 61. The guide rod is integrally formed with a bracket 33 (commonly called a "foot") which extends circumferentially from the guide rod to either side. The bracket contains two circular apertures 62, 63. The surface of the nozzle ring 5 which faces away from the shroud 6 is formed with two bosses 34, 64 which project from the nozzle ring 6. Each of the bosses 34, 64 have a circular profile (viewed in the axial direction). The bosses 34, 64 are inserted respectively in the apertures 62, 63, and bosses 34, 64 are sized such that the boss 34 substantially fills the aperture 62, while the boss 64 is narrower than the aperture 63. The connection between the boss 34 and the aperture 62 fixes the circumferential position of the nozzle ring 5 with respect to the bracket 33 (in typical realizations, the relative circumferential motion of the nozzle ring 5 and the shroud 6 about the axis 100 is no more than 0.05 degrees). However, the clearance between the boss 64 and the aperture 63 permits the bracket 33 to rotate slightly about the boss 34 if the guide rods move apart radially due to thermal expansion. For that reason, the boss 34 is referred to as a "pivot".

The location, as viewed in the axial direction, at which a second of the guide rods is connected to the nozzle ring 5 is shown as 31. The connection between the nozzle ring 5 and the second guide rod is due to a second bracket (not visible in FIG. 2) integrally attached to the second guide rod. The second bracket is attached to the rear surface of the nozzle ring 5 in the same way as the bracket 33. The pivot for the second bracket is at the location 35.

Holes 24, 25 are balance holes provided in the nozzle ring for pressure equalisation. They are provided to achieve a desirable axial load (or force) on the nozzle.

Figure 3:
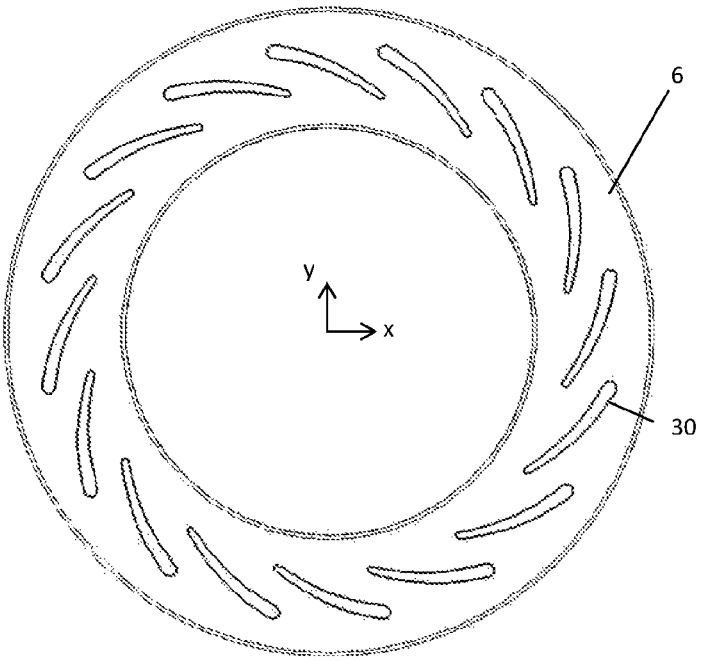
FIG. 3 is an axial view of a shroud which can be used in the known arrangement of FIG. 1.

Facing the nozzle ring 5, is the shroud 6 illustrated in FIG. 3. FIG. 3 is a view looking towards the shroud 6 from the nozzle ring 5 (i.e. towards the right side of FIG. 1). The shroud defines slots 30 (that is, through-holes) for receiving respective ones of the vanes 7.

Figure 4:
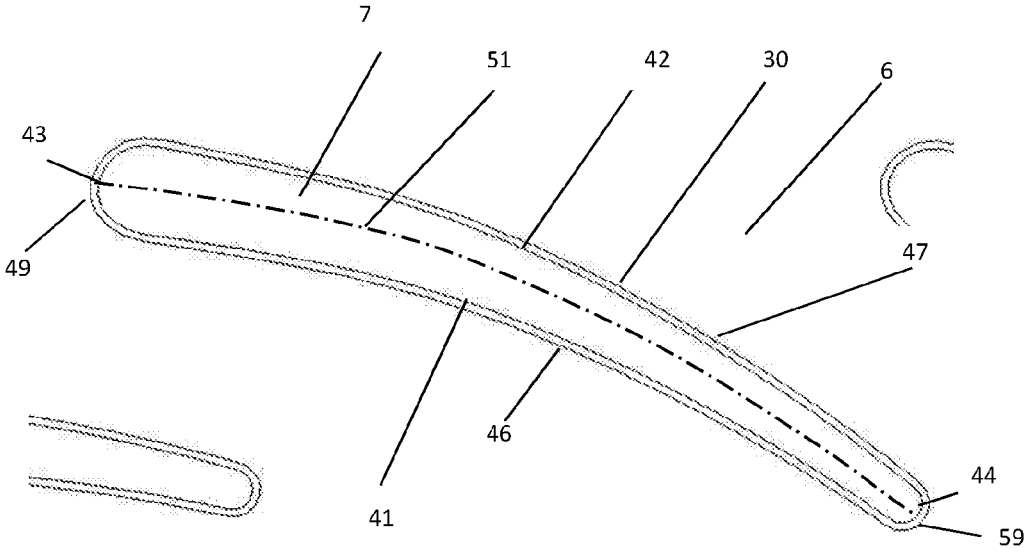
FIG. 4 shows the positional relationship between the vanes of FIG. 2 and the shroud of FIG. 3.

FIG. 4 is a view looking in the axial direction from the nozzle ring 5 towards the shroud 6 (i.e. towards the right side of FIG. 1(*a*)), showing a representative vane 7 inserted into a respective slot 30. The vane 7 has a generally arcuate (crescent-shaped) profile, although in other forms the vanes are substantially planar. Specifically, the vane 7 has a vane inner surface 41 which is closer to the wheel. The vane inner surface 41 is typically generally concave as viewed in the axial direction, but may alternatively be planar. The vane 7 also has a vane outer surface 42 which is closer to the exhaust gas inlet of the turbine. The vane outer surface 42 is typically convex as viewed in the axial direction, but may also be planar. The major surfaces 41, 42 of the vane 7 face in generally opposite directions, and are connected by two axially-extending end surfaces 43, 44 which, as viewed in the axial direction, each have smaller radii of curvature than either of the surfaces 41, 42. The end surfaces 43, 44 are referred to as the leading edge surface 43 and the trailing edge surface 44. The vane outer surface 42 is arranged to oppose the motion of the exhaust gas the inlet passageway, i.e. the motion of the exhaust gas in the inlet passageway is such as to direct the exhaust gas against the vane outer surface.

As viewed in the axial direction, each vane 7 has a median line 51 which extends from one end of the vane to the other (half way between the vane inner and outer surfaces 41, 42 when viewed in the axial direction), and this median line has both a radial and a circumferential component. We refer to the surface of the slot which the vane inner surface 41 faces as the slot inner surface 46, and the surface of the slot which the vane outer surface 42 faces as the slot outer surface 47. As shown in FIG. 4, there is a gap of substantially constant width between the periphery of the vane 7 and the surface of the slot 30. This gap includes four portions: between the vane inner surface 41 and the slot inner surface 46; between the vane outer surface 42 and the slot outer surface 47; and between the vane's leading and trailing edge surfaces 43, 44, and respective leading and trailing portions 49, 59 of the edge of the slot.

Figure 5:
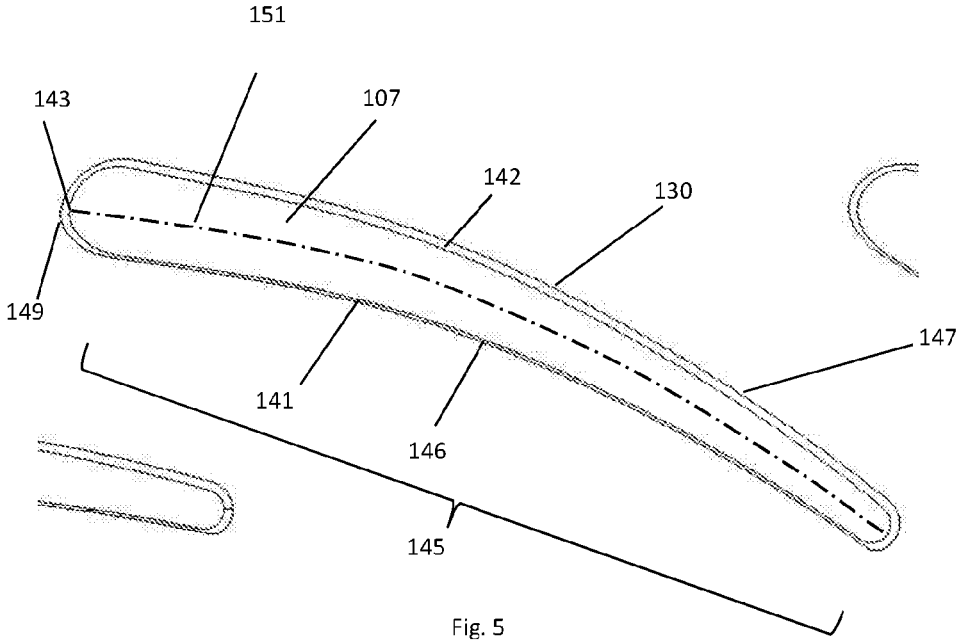
FIG. 5 shows the positional relationship between the vanes and shroud of a first embodiment of the invention.

Turning to FIG. 5, a vane and shroud slot are shown of a turbine which is a first embodiment of the invention. The turbine has the form illustrated in FIGS. 1 and 2, with the difference that the vanes and/or slots in the shroud are differently shaped and/or sized. In FIG. 5, elements corresponding to elements of FIGS. 1 to 4 are given reference numerals 100 higher. Thus, a representative vane 107 is depicted within a representative slot 130. The vane outer surface 142 faces a slot outer surface 147, and a vane inner surface 141 faces a slot inner surface 146. Optionally, the vane 107 may be longitudinally-symmetric along the whole of its length (i.e. with the same profile, as viewed in the axial direction, in all axial positions). In another possibility, only a part of the vane 107 may be axially symmetric, e.g. including the portion which can be inserted into the slot 130 when the vane 107 is in its most advanced position. In this case, the portion of the vane shown in FIG. 5 is part of this axially symmetric portion of the vane. The vane 107 is integrally formed with the nozzle ring 5, as a one-piece unit, for example by casting and/or machining.

In contrast to the known vanes of FIG. 4, the vane of FIG. 5 has a narrower clearance between the vane inner surface 141 and the opposed slot inner surface 146. By contrast, a much wider gap exists between the vane outer surface 142 and the corresponding portion 147 of the slot outer surface 147. This means that exhaust gas entering in the shroud recess between the outer vane surface 142 and the slot outer surface 147 is largely prevented from exiting the shroud recess between the vane inner surface 141 and the slot inner surface 146.

To facilitate this, the vane surface and slot surface are formed with a conformal portion 145 which extends along at least about 80% of the length of the median line 151, or even at least 85% or 90% of the length of the median line 151. The conformal portion 145 of the vane surface in FIG. 5 includes substantially all of the vane inner surface 141. The profile (that is the shape, as viewed in the axial direction) of the vane inner surface 141 and a corresponding portion of the slot inner surface 146 are very similar to each other, so that they can be placed against each other with a very small gap between them along the whole length of the conformal portion 145. Specifically, the profile of the vane inner surface 141 and the corresponding portion of the slot inner surface 146 at room temperature are such that they may be positioned against each other with a gap between them which, transverse to the median line, is no more than 0.35% of the nozzle radius 71, and preferably no more than 0.2% of the nozzle radius 71. On average over the conformal portion 145 of the vane surface, the gap between the vane inner surface 141 and the slot inner surface 146 is no more than 20%, or no more than 10% of the gap between the vane outer surface 142 and the slot outer surface 147. At room temperature, the profile of the conformal portion of the vane inner surface diverges from the profile of the corresponding portion of the slot inner surface by no more than 0.35% of the nozzle radius, more preferably by no more than 0.2% of the nozzle radius, throughout their respective lengths. The vane's leading edge surface 143 is spaced from the corresponding portion of the inner surface of the slot 149.

In use, various elements of the turbine expand as they become larger. Optionally the material of the nozzle ring 5, including the vanes 107, and the material of the shroud 6 may have the same coefficient of thermal expansion. For example, they may be formed of the same material. This means that both may expand in the same proportions as the temperature of the turbine increases, so that the clearance between the vanes 107 and the slot 130 remains around the entire periphery of the vane 107.

It may happen, however, that the vanes 107 and shroud 6 expand in different proportions (for example, because they are formed from different materials and/or experience different temperatures). Due to the coupling of the nozzle ring 5 to the rods illustrated in FIG. 2, the nozzle ring may have a certain inherent freedom to rotate about the axis 100. Experimentally, we have found that this may be up to 0.05°. Thus, if, due to the thermal expansion, the vane inner surface 141 comes into contact with the slot inner surface 146, any force exerted by the slot inner surface 146 on the vane 107 causes the nozzle ring 5 to rotate relative to the shroud 6, so as to relieve this stress. Thus, despite the thermal expansion, the conformal portion of the vane 107 remains in close contact with the slot inner surface, without a high force being transmitted from one to the other. This means that no significant frictional force is developed between the vane 107 and the shroud 6 which might cause the reciprocating motion of the nozzle ring to be impeded.

Figure 6:
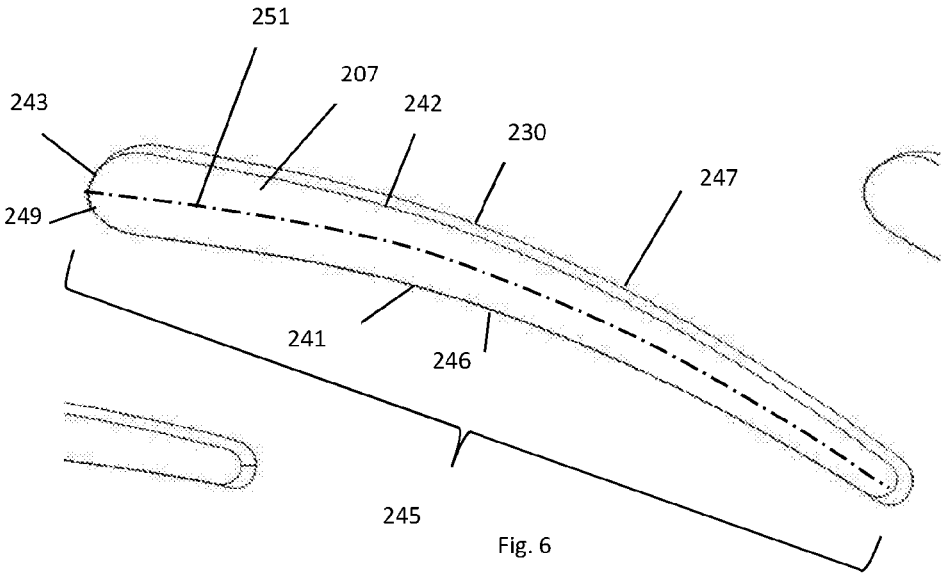
FIG. 6 shows the positional relationship between the vanes and shroud of a second embodiment of the invention.

Turning to FIG. 6, the vane 207 and slot 230 of a second embodiment of the invention are shown. Elements of the second embodiment having the same meaning as in FIG. 5 are given reference numerals 100 higher. The vane surface and slot surface are formed with a conformal portion 245 which extends along at least about 90% of the length of the median line 251. The conformal portion 245 of the vane surface in FIG. 6 includes substantially all of the vane inner surface 241 and also the majority of the vane leading end surface 243. At room temperature, the profile of the vane inner surface 241 and a corresponding portion of the slot inner surface 246 are substantially identical to within machining tolerances, so that they can be placed against each other with substantially no gap between them along the whole length of the conformal portion 245. There is a gap between the outer surface 242 of the vane 207 and the facing portion 247 of the slot 230.

Figure 7:
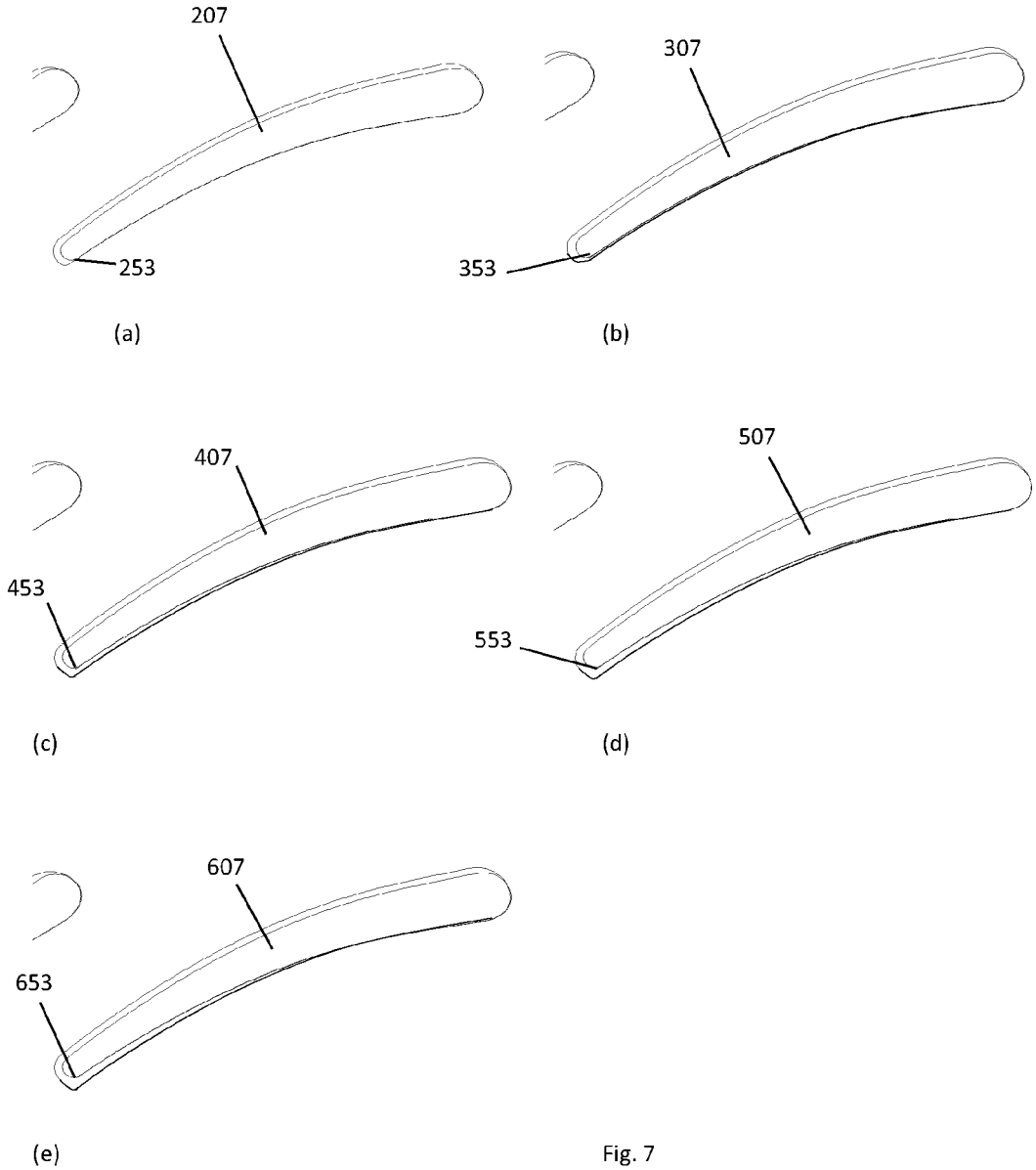
FIG. 7, which is composed of FIGS. 7(*a*) to 7(*e*), which show respectively the second embodiment, and, for comparison, three further embodiments and a comparative example.

FIG. 7(*a*) shows the second vane 207 and slot of the second embodiment of the invention as viewed in the opposite direction along the axis from the view of FIG. 6. As in FIG. 6, the leading end surface 243 of the vane 207 lies along the leading edge surface 249 of the slot 230. The trailing end 253 of the vane inner surface 241 is in contact with (i.e. is spaced by 0 mm from) the slot inner surface 246. This represents the ideal case, but it may not be achievable in practice due to machining tolerences.

By contrast, FIGS. 7(*b*) to 7(*d*) show three respective further embodiments in each of which the nozzle radius is 48.1 mm. The leading end of the respective representative vane 307, 407, 507 lies along the leading edge surface of the slot, but the respective trailing ends 353, 453, 553, 653 of the vanes 307, 407, 507 are respectively spaced from the inner surface of the slot by distances of 0.05 mm (i.e. 0.1% of the nozzle radius), 0.1 mm (i.e. 0.2% of the nozzle radius), and 0.15 mm (i.e. 0.3% of the nozzle radius). Due to machining tolerances these may the spacings which are achieved in practice when it is attempted to produce the idea situation of FIG. 7(*a*). The embodiments of FIGS. 7(*b*) to 7(*d*) are successively less successful at preventing gas from leaking from the outer surface of the vane to the inner surface, although they are still successful at inhibiting gas flow to some degree. FIG. 7(*e*) shows a comparative example in which the leading edge of the representative vane 607 lies along the leading edge surface of the slot, but the trailing edge 653 of the vane 607 is spaced from the inner surface of the slot by a distance of 0.2 mm (i.e. 0.4% of the nozzle radius). The gas leakage in this case is significantly greater than in the embodiments of FIGS. 7(*a*)-(*d*).

Figure 8:
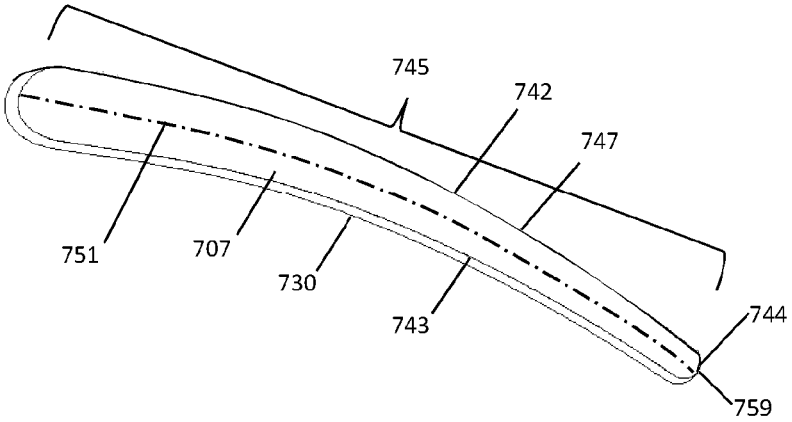
FIG. 8 shows the positional relationship between the vanes and shroud of a further embodiment of the invention.

Turning to FIG. 8, a vane 707 and slot 730 of further embodiment of the invention are shown. In this embodiment the conformal portion 745 includes most of the outer surface 742 of the vane 707, which lies against the slot outer surface 747 along at least 80% of the length of the median line 751. It further includes the trailing surface 744 which lies against the corresponding portion 759 of the slot edge up to a position which is radially inward of the intersection of the median line 751 with the trailing surface 744. This embodiment impedes gas flow from the outer surface 742 of the vane 707 to the inner surface 743 by substantially preventing gas leaking between the outer surface 742 and the slot outer surface 747. Again, if there is differential thermal expansion between the vane 707 and the shroud, this can be absorbed by tolerances in the system, so that the vane 707 is not pushed so hard against the slot outer surface 747 as to prevent axial motion of the vane relative to the shroud.

The invention claimed is:

1. A turbine for a turbocharger arranged to receive exhaust gas to drive a turbine wheel having:

a turbine housing defining a gas inlet;

the turbine wheel positioned for rotation within the turbine housing about an axis;

a ring-shaped shroud defining a plurality of slots, and encircling the axis; and a nozzle ring supporting a plurality of vanes which extend from the nozzle ring parallel to the axis, and project through respective ones of the slots, each of the vanes being spaced from the axis by a nozzle radius;

the shroud being coupled to the nozzle ring;

each of the slots having an inwardly facing slot surface, and each of the vanes having an axially-extending vane surface which includes (i) a vane outer surface facing an outer surface of the corresponding slot, (ii) an opposed vane inner surface facing an inner surface of the corresponding slot, and (iii) a median line between the vane inner surface and the vane outer surface extending from a first end of the vane to a second end of the vane;

the vane surface including a conformal portion, extending along at least 80% of the length of the median line, and facing a corresponding conformal portion of the slot surface, wherein, at room temperature, the respective profiles of the conformal portion of the vane surface and the conformal portion of the slot surface diverge from each other by no more than 0.35% of the nozzle radius.

2. The turbine according to claim 1 in which, at room temperature, the conformal portion of the vane surface has a profile which diverges from the profile of the conformal portion of the slot surface by no more than 0.3% of the nozzle radius throughout their respective lengths.

3. The turbine according to claim 1, in which, at room temperature, the conformal portion of the vane surface and the conformal portion of the slot surface are positionable with a gap of no more than 0.35% of the nozzle radius between them along the whole of their respective lengths.

4. The turbine according to claim 1, in which, at room temperature, the conformal portion of the vane surface and the conformal portion of the slot surface are positionable with a gap of no more than 0.2% of the nozzle radius between them along the whole of their respective lengths.

5. The turbine according to claim 1, in which, at room temperature, the conformal portion of the vane surface and the conformal portion of the slot surface are positionable with a gap of no more than 0.1% of the nozzle radius between them along the whole of their respective lengths.

6. The turbine according to claim 1, in which, at room temperature, the conformal portion of the vane surface and the conformal portion of the slot surface are positionable substantially in contact along the whole of their respective lengths.

7. The turbine according to claim 1, in which the conformal portion of the vane surface includes at least 80% of the vane inner surface.

8. The turbine according to claim 7, in which the vane inner surface extends between two convex end portions of the vane, and the conformal portion of the vane surface includes a portion of a first of the convex end portions of the vane surface, at a leading edge of the vane.

9. The turbine according to claim 7 in which, at room temperature, on average over the conformal portion of the vane surface, there is a gap between the vane inner surface and the slot inner surface which is no more than 20% of a gap between the vane outer surface and the slot outer surface.

10. The turbine according to claim 1, in which the conformal portion of the vane surface includes at least 80% of the vane outer surface.

11. The turbine according to claim 10, in which the vane outer surface extends between two convex end portions of the vane, and the conformal portion of the vane surface includes a portion of a first of the convex end portions of the vane surface, at a trailing edge of the vane.

12. The turbine according to claim 10 in which, on average over the conformal portion of the vane surface, there is a gap between the vane outer surface and the slot outer surface which is no more than 20%, of a gap between the vane inner surface and the slot inner surface.

13. The turbine according to claim 1 in which the conformal portion of the vane surface extends along at least 85% of the length of the median line.

14. The turbine according to claim 1 in which the conformal portion of the vane surface extends along at least 90% of the length of the median line.

15. A turbocharger comprising a turbine, the turbine having:

a turbine housing defining a gas inlet;

a turbine wheel positioned for rotation within the turbine housing about an axis;

a ring-shaped shroud defining a plurality of slots and encircling the axis; and a nozzle ring supporting a plurality of vanes which extend from the nozzle ring parallel to the axis, and project through respective ones of the slots, each of the vanes being spaced from the axis by a nozzle radius;

the shroud being coupled to the nozzle ring;

each of the slots having an inwardly facing slot surface, and each of the vanes having an axially-extending vane surface which (i) a vane outer surface facing an outer surface of the corresponding slot, (ii) an opposed vane inner surface facing an inner surface of the corresponding slot, and (iii) a median line between the vane inner surface and the vane outer surface extending from a first end of the vane to a second end of the vane, the vane surface including a conformal portion, extending along at least 80% of the length of the median line, and facing a corresponding conformal portion of the slot surface, wherein, at room temperature, the respective profiles of the conformal portion of the vane surface and the conformal portion of the slot surface diverge from each other by no more than 0.35% of the nozzle radius.

16. The turbocharger of claim 15 in which, at room temperature, on average over the conformal portion of the vane surface, there is a gap between the vane inner surface and the slot inner surface which is no more than 20% of a gap between the vane outer surface and the slot outer surface.

17. A turbine for a turbocharger arranged to receive exhaust gas to drive a turbine wheel, the turbine having:

a turbine housing defining a gas inlet;

the turbine wheel positioned for rotation within the turbine housing about an axis;

a ring-shaped shroud defining a plurality of slots and encircling the axis; and a nozzle ring supporting a plurality of vanes which extend from the nozzle ring parallel to the axis, and project through respective ones of the slots, each of the vanes being spaced from the axis by a nozzle radius;

the shroud being coupled to the nozzle ring;

each of the slots having an inwardly facing slot surface, and each of the vanes having an axially-extending vane surface which includes (i) a vane outer surface facing an outer surface of the corresponding slot, (ii) an opposed vane inner surface facing an inner surface of the corresponding slot, and (iii) a median line between the vane inner surface and the vane outer surface extending from a first end of the vane to a second end of the vane, the vane surface including a conformal portion, extending along at least 80% of the length of the median line, and facing a corresponding conformal portion of the slot surface, wherein, at room temperature, the respective profiles of the conformal portion of the vane surface and the conformal portion of the slot surface diverge from each other by no more than 0.35% of the nozzle radius defining a gap between the inwardly-facing slot surface and the vane surface that is smaller than a gap between portions of the inwardly-facing slot surface and the vane surface extending along the length of the conformal portions on the opposite side of the median line from the conformal portions.

18. The turbine of claim 17 in which, at room temperature, on average over the conformal portion of the vane surface, there is a gap between the vane inner surface and the slot inner surface which is no more than 20% of a gap between the vane outer surface and the slot outer surface.

19. A combination of a nozzle ring and shroud for a turbine of a turbocharger arranged to receive exhaust gas to drive a turbine wheel, the turbine having:

a turbine housing defining a gas inlet, and configured to receive the nozzle ring and the shroud; and the turbine wheel positioned for rotation within the turbine housing;

wherein:

the shroud is coupled to the nozzle ring, is ring-shaped and defines a plurality of slots; and the nozzle ring supports a plurality of vanes which extend from the nozzle ring parallel to an axis of the nozzle ring, each of the vanes being spaced from the axis by a nozzle radius;

each of the slots having an inwardly facing slot surface, and each of the vanes having an axially-extending vane surface which includes (i) a vane outer surface, (i) an opposed vane inner surface, and (iii) a median line between the vane inner surface and the vane outer surface extending from a first end of the vane to a second end of the vane;

the vane surface including a conformal portion, extending along at least 80% of the length of the median line;

the plurality of vanes being adapted for insertion into respective ones of the slots of the shroud with the corresponding vane outer surface facing an outer surface of the corresponding slot, the corresponding vane inner surface facing an inner surface of the corresponding slot, and the conformal portion of the vane surface facing a corresponding conformal portion of the slot surface; and wherein, at room temperature, the respective profiles of the conformal portion of the vane surface and the conformal portion of the slot surface diverge from each other by no more than 0.35% of the nozzle radius.

20. The combination of claim 19 in which, at room temperature, on average over the conformal portion of the vane surface, there is a gap between the vane inner surface and the slot inner surface which is no more than 20% of a gap between the vane outer surface and the slot outer surface.

* * * * *